US005261852A

United States Patent [19]

Ejima

[11] Patent Number: 5,261,852

[45] Date of Patent: Nov. 16, 1993

[54] SHOOTING DEVICE FOR TOY

[75] Inventor: Takio Ejima, Sakura, Japan

[73] Assignee: Takara Co., Ltd., Tokyo, Japan

[21] Appl. No.: 931,148

[22] Filed: Aug. 17, 1992

[30] Foreign Application Priority Data

Jul. 6, 1992 [JP] Japan ..... 4-20245

[51] Int. Cl.[5] ..... A63H 5/04; F41A 33/00

[52] U.S. Cl. ..... 446/405; 446/473; 124/27

[58] Field of Search ..... 446/405, 406, 407, 473; 124/16, 26, 27, 49, 82

[56] References Cited

U.S. PATENT DOCUMENTS 729,453 5/1903 Tuttle ..... 124/49 X
2,371,249 3/1945 Majewski ..... 124/27
4,365,439 12/1982 Litynski ..... 446/406
4,808,143 2/1989 Kuo ..... 446/406

*Primary Examiner*—Mickey Yu
*Attorney, Agent, or Firm*—Price, Gess & Ubell

[57] ABSTRACT

A shooting device for a toy capable of providing interest and pleasure and exhibiting reality. The shooting device includes a shooting device body which is provided with a shooting mechanism for forward shooting bullets from the device one by one at every operation thereof and a bullet storage section for storing bullets therein. The bullets are fed from the bullet storage section to the shooting mechanism one by one by gravity at every operation of the shooting mechanism. In the shooting device body is arranged a sound producing unit for producing a bullet charging sound and a bullet shooting sound in association with the bullet charging operation and bullet shooting operation of the shooting mechanism.

12 Claims, 2 Drawing Sheets

SHOOTING DEVICE FOR TOY

BACKGROUND OF THE INVENTION

This invention relates to a shooting device for a toy, and more particularly to a shooting device for a toy for successively charging and shooting bullets while concurrently producing sounds associated with the charging and shooting operation.

A shooting device for a toy which has been conventionally known in the art is constructed so as to shoot a charged bullet by means of elastic force. Unfortunately, the conventional shooting device is adapted to charge or store only one bullet therein for shooting. More particularly, the conventional shooting device for a toy fails to permit bullets to be successively charged in and shot from the device while concurrently producing sounds associated with charging and shooting of the bullets, resulting in failing to provide a user with interest and pleasure and exhibit reality.

SUMMARY OF THE INVENTION

The present invention has been made in view of the foregoing disadvantage of the prior art.

Accordingly, it is an object of the present invention to provide a shooting device for a toy which is capable of providing a user with interest and pleasure.

It is another object of the present invention to provide a shooting device for a toy which is capable of exhibiting reality.

It is a further object of the present invention to provide a shooting device for a toy which is capable of accomplishing the above-described objects with a simple structure.

In accordance with the present invention, a shooting device for a toy is provided. The shooting device includes a shooting device body constituting a base of the shooting device, a shooting mechanism arranged at the shooting device body for forward shooting bullets one by one from the shooting device every time when it is operated, and a bullet storage section arranged on the shooting mechanism for storing a plurality of bullets therein. The bullet storage section is arranged so as to communicate with the shooting mechanism, to thereby permit the bullets to be fed to the shooting mechanism one by one at every operation of the shooting mechanism and a sound producing unit operatively connected to the shooting mechanism for producing a bullet charging sound and a bullet shooting sound at every operation of the shooting mechanism.

In a preferred embodiment, the bullets are stored in the bullet storage section in a manner to be stacked together. The bullets are fed from the bullet storage section to the shooting mechanism by gravity.

In a preferred embodiment of the present invention, the shooting device further includes a bullet guide means for ensuring smooth and positive feeding of each of the bullets from the bullet storage section to the shooting mechanism. The bullet guide means may comprise guide projections provided on an inner surface of the bullet storage section in a manner to be opposite to each other and vertically extend and a groove formed on each of the bullets so as to be fitted on the guide projections when it is stored in the bullet storage section.

BRIEF DESCRIPTION OF THE DRAWINGS

These and other objects and many of the attendant advantages of the present invention will be appreciated as the same becomes better understood by reference to the following detailed description when considered in connection with the accompanying drawings in which like reference numerals designate like parts throughout; wherein.

DETAILED DESCRIPTION OF THE PREFERRED EMBODIMENT

A shooting device for a toy according to the present invention will be described hereinafter with reference to the accompanying drawings.

Figure 1:
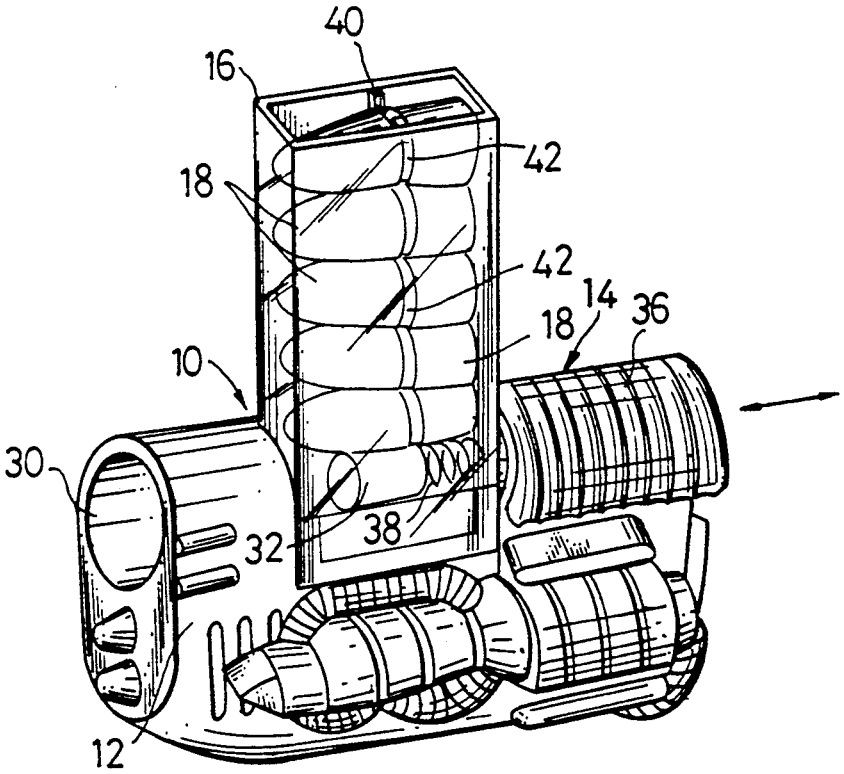
FIG. 1 is a perspective view showing an embodiment of a shooting device for a toy according to the present invention.
Figure 2:
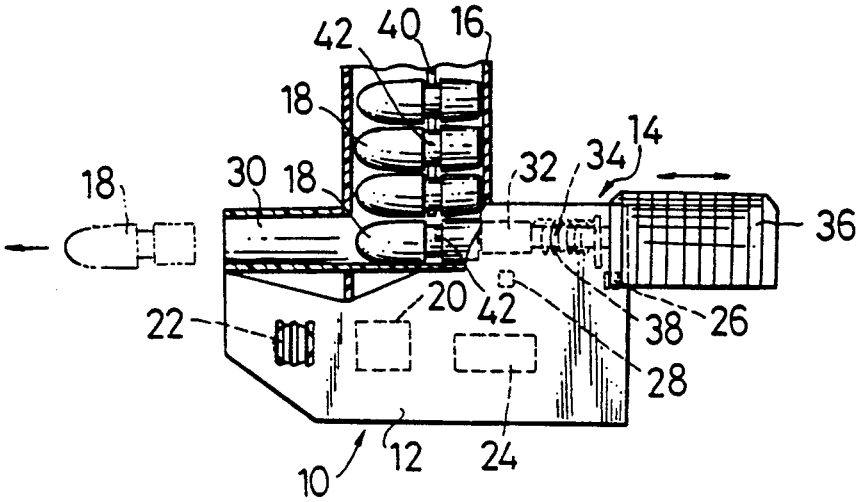
FIG. 2 is a partially cutaway schematic view partly in section showing an internal structure of the shooting device shown in FIG. 1.
Figure 3:
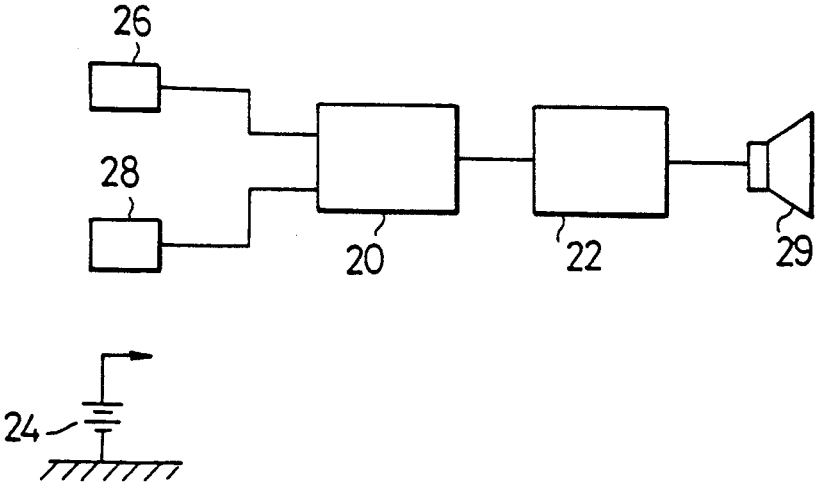
FIG. 3 is a block diagram showing an electrical circuit of the shooting device shown in FIG. 1.

FIGS. 1 and 2 show an embodiment of a shooting device for a toy according to the present invention, wherein a shooting device of the illustrated embodiment is generally designated at reference numeral 10. The shooting device 10 generally includes a shooting device body 12 constituting a base of the device 10, a shooting mechanism 14 and a bullet or projectiles, storage section 16 for receiving or storing a plurality of bullets or projectiles 18 therein. In the illustrated embodiment, the bullets 18 are received in the bullet storage section 16 while being stacked or vertically superposed on each other.

In the shooting device body 12 are arranged a microcomputer 20, a sound producing unit 22 comprising a sound synthesizing IC controlled through the microcomputer 20 to selectively produce one of sounds predetermined in association with charging and shooting of the bullets, a replaceable battery means 24 for a power supply, and switches 26 and 28 operated by operation of the shooting mechanism 14, which are electrically connected to each other. Reference numeral 29 designates a loudspeaker.

The shooting mechanism 14 includes a shooting cylinder 30 arranged so as to communicate with the bullet storage section 16 for permitting the bullets 18 to be fed from the bullet storage section 16 to the shooting mechanism 14. In the illustrated embodiment, the shooting cylinder 30 is provided at an upper portion of the shooting device body 12. The shooting mechanism 14 further includes a projecting member 32 arranged in the shooting cylinder 30 so as to be slidable in a longitudinal direction of the shooting cylinder 30 and having an extension 34 integrally provided thereon so as to rearward extend therefrom, a movable member 36 connected to a distal end of the extension 34 of the projecting member 32 and a spring member 38 for constantly forwardly urging the projecting member 32. In the illustrated embodiment, the spring member 38 comprises a coiled spring wound on the extension 34. The movable member 36 is arranged so as to cover an upper portion of a rear section of the shooting device body 12 and in such a manner that movement of the movable member in a rearwardly direction of the shooting device body 12 permits the projecting member 32 to be rearwardly moved against the spring member 38.

The bullet storage section 16 is arranged on the shooting mechanism 14 and formed into a shape like a hollow rectangular cylinder. The bullet storage section 16 is provided on an inner side surface thereof opposite to each other with a pair of guide projections 40 in a manner to vertically extend and be opposite to each other. Correspondingly, each of the bullets 18 is provided on an outer periphery thereof with a groove 42, which is fitted on the guide projections 40 of the bullet storage section 16, resulting in facilitating positive and smooth falling of the bullet, when it is received in the bullet storage section 16.

Now, the manner of operation of the shooting device of the illustrated embodiment constructed as described above will be described hereinafter.

First, the bullets 18 are received in the bullet storage section 16 in a manner to be stacked together. Then, the movable member 36 is pulled or rearward moved, to thereby cause the projecting member 32 to be rearward moved in the shooting cylinder 30 against the spring member 38. This results in lowermost one of the bullets in the bullet storage section 16 falling into the shooting cylinder 30 of the shooting mechanism 14 by gravity. Concurrently, the above-described movement of the movable member 36 causes the switch 26 arranged in the shooting device body 12 to be turned on, so that a bullet charging sound may be generated from the sound producing unit 22 while being controlled and selected by the microcomputer 20.

Then, when the movable member 36 is released, the projecting member 32 is forwardly forced together with the movable member 36 by the spring member 38, resulting in the lowermost bullet 18 being shot from the shooting cylinder 30. At this time, the movable member 36 forward movement turns on the switch 28 arranged in the shooting device body 12, so that a bullet shooting sound may be produced from the sound producing unit 22 while being controlled and selected by the microcomputer 20.

Repeating of rearward pulling and releasing of the movable member 36 permits charging and shooting of the bullets with respect to the shooting mechanism 14 to be repeatedly successively carried out while permitting sounds associated therewith to be successively produced from the sound producing unit 22.

Thus, in the shooting device 10 of the illustrated embodiment constructed as described above, every rearward movement of the movable member 36 permits the bullets 18 housed in the bullet storage section 16 to fall into the shooting cylinder 30 of the shooting mechanism 14 one by one by gravity. Then, releasing of the movable member 36 permits the projecting member 32 to be forwardly forced together with the movable member 36 by the spring member 34, resulting in the bullet 18 in the shooting cylinder 30 to be shot from the shooting cylinder 30. Repeating of such operations permits charging and shooting of the bullets to be successively repeated, so that a user may take much pleasure and interest.

Also, a bullet charging sound is produced from the sound producing unit 22 every time when the bullet 18 is charged in the shooting cylinder 30 and a bullet shooting sound is generated from the unit 22 every time when the bullet is shot from the shooting cylinder 30. This results in the shooting device giving variety to play and exhibiting reality.

The shooting device of the illustrated embodiment may be conveniently mounted on a suitable toy such as a toy robot, an armed vehicle toy or the like, so that the toy may be provided with variety. Also, a sound is produced from the sound producing unit 22 while being controlled through the microcomputer 20. However, the present invention is not limited to such construction. For example, it may be so constructed that the bullet charging sound and bullet shooting sound may be produced directly from the sound producing unit 22. Also, in the present invention, the two switches 26 and 28 are arranged, however, a single switch could be provided to permit the bullet charging sound and bullet shooting sound to be produced from the sound producing unit 22.

As can be seen from the foregoing, the shooting device of the present invention is so constructed that every operation of the shooting mechanism permits the bullets to fall into the shooting mechanism one by one and be shot from the shooting device. Such construction permits a user to be provided with pleasure and interest. Also, the shooting device of the present invention produces the bullet charging sound and bullet shooting sound every time when the bullet is charged in the shooting mechanism and shot from the shooting device, so that the shooting device exhibits satisfactory reality.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A shooting device for a toy comprising:

a shooting device body constituting a base of the shooting device;

a shooting mechanism arranged at said shooting device body for shooting bullets, one by one, from the shooting device every time it is operated;

a bullet storage section arranged on said shooting mechanism for storing a plurality of bullets therein;

said bullet storage section being arranged so as to communicate with said shooting mechanism, to thereby permit said bullets to be fed to said shooting mechanism one by one at every operation of said shooting mechanism; and a sound-producing unit, operatively connected to said shooting mechanism, for producing a bullet charging sound and a bullet shooting sound at every operation of said shooting mechanism, including a switch means which is operated by said shooting mechanism to actuate said sound-producing unit at every operation of said shooting mechanism.

2. A shooting device as defined in claim 1, wherein said bullets are stored in said bullet storage section in a manner to be stacked together.

3. A shooting device as defined in claim 2, wherein said bullets are fed from said bullet storage section to said shooting mechanism by gravity.

4. A shooting device as defined in claim 1, further comprising a bullet guide means for ensuring smooth and positive feeding of each of said bullets from said bullet storage section to said shooting mechanism.

5. A shooting device as defined in claim 4, wherein said bullet guide means comprises guide projections provided on an inner surface of said bullet storage section in a manner to be opposite to each other and vertically extend and a groove formed on each of said bullets so as to be fitted on said guide projections when it is stored in said bullet storage section.

6. A shooting device as defined in claim 3, further comprising a bullet guide means for ensuring smooth and positive feeding of each of said bullets from said bullet storage section to said shooting mechanism.

7. A shooting device as defined in claim 6, wherein said bullet guide means comprises guide projections provided on an inner surface of said bullet storage section in a manner to be opposite to each other and vertically extend and a groove formed on each of said bullets so as to be fitted on said guide projections when it is stored in said bullet storage section.

8. A shooting device as defined in claim 7, wherein said shooting mechanism comprises a shooting cylinder arranged so as to communicate with said bullet storage section, a projecting member slidably arranged in said shooting cylinder, a movable member connected to said projecting member and a spring member urging forwardly said projecting member.

9. A shooting device as defined in claim 1, wherein said switch means comprises a pair of switches, one of said switches being activated through a rearward movement of said movable member so as to actuate said sound producing unit for generating said bullet charging sound, and the other of said switches being activated through a forward movement of said movable member so as to actuate said sound producing unit for generating said bullet shooting sound.

10. A shooting device as defined in claim 9, wherein said sound producing unit further includes a sound synthesizing IC, and a microcomputer electrically connected to said switches, said sound synthesizing IC being controlled through said microcomputer to selectively produce one of said bullet charging and bullet shooting sounds.

11. A shooting device for a toy, comprising:

a hollow barrel member;

a projectile storage section connected to the barrel member and storing a plurality of projectiles that can be successively loaded into the barrel member;

a shooting mechanism connected to the barrel member for propelling the projectiles from the barrel member;

a sound-producing unit, including a soundsynthesizing integrated circuit means for providing a simulated projectile loading sound to charge the barrel member and a simulated firing sound of a projectile ejected from the barrel member; and switch means, connected to the shooting mechanism, to activate the sound-producing unit to provide a corresponding simulated sound relative to loading a projectile and firing a projectile from the barrel member.

12. A shooting device as defined in claim 11, further comprising a projectile guide means for ensuring smooth and positive feeding of each of said projectiles from said projectile storage section to said shooting mechanism.

* * * * *